United States Patent [19]

Hasuly et al.

[11] Patent Number: 4,859,509

[45] Date of Patent: Aug. 22, 1989

[54] TEXTILE WARP SIZE

[75] Inventors: Michael J. Hasuly, South Plainfield; Peter T. Trzasko, Plainsboro, both of N.J.

[73] Assignee: National Starch and Chemical Corporation, Bridgewater, N.J.

[21] Appl. No.: 173,855

[22] Filed: Mar. 28, 1988

Related U.S. Application Data

[60] Division of Ser. No. 909,976, Sep. 22, 1986, Pat. No. 4,758,279, which is a continuation-in-part of Ser. No. 725,026, Apr. 19, 1985, abandoned.

[51] Int. Cl.[4] ..... B65H 71/00; C08L 3/00; B05D 1/18

[52] U.S. Cl. ..... 427/442; 28/178; 106/212; 427/443

[58] Field of Search ..... 8/115.6; 106/212; 536/50, 110, 111, 107; 28/178; 427/443, 442

[56] References Cited

U.S. PATENT DOCUMENTS

| | | | |
|---|---|---|---|
| Re. 28,809 | 5/1976 | Tessler | 260/233.5 |
| 2,661,349 | 12/1953 | Caldwell et al. | 260/224 |
| 2,813,093 | 11/1957 | Caldwell et al. | 260/233.3 |
| 2,876,217 | 3/1959 | Paschall | 260/233.3 |
| 2,946,705 | 7/1960 | Olsen | 117/139.5 |
| 3,650,787 | 3/1972 | Elizer | 106/213 |
| 3,664,855 | 5/1972 | Morrison et al. | 106/212 |
| 3,673,171 | 6/1972 | Elizer | 260/233.3 |
| 3,719,664 | 3/1973 | Hayes et al. | 106/213 |
| 4,020,272 | 4/1977 | Tessler | 536/107 |
| 4,421,566 | 12/1983 | Hasuly et al. | 106/213 |
| 4,626,288 | 12/1986 | Trzasko et al. | 106/212 |
| 4,758,279 | 7/1988 | Hasuly | 106/212 |

FOREIGN PATENT DOCUMENTS

| | | | |
|---|---|---|---|
| 1444449 | 7/1976 | United Kingdom | 106/212 |

*Primary Examiner*—Theodore Morris

*Attorney, Agent, or Firm*—Edwin M. Szala; Lori D. Tolly

[57] ABSTRACT

Textile warp sizing compositions and hydrophobic starch derivatives useful therefor are provided. The compositions strengthen and protect warp yarns as well as render textile lubricants uniformly dispersible thereon. The compositions additionally facilitate efficient lubricant removal during desizing. The hydrophobic starch derivatives contain an ether, simple ester of half-acid ester substituent with a saturated or unsaturated hydrocarbon chain of at least 5 carbon atoms.

11 Claims, No Drawings

TEXTILE WARP SIZE

BACKGROUND OF THE INVENTION

This application is a division of application Ser. No. 909,976, filed Sept. 22, 1986, now U.S. Pat. No. 4,758,279, which is a continuation-in-part of copending application Ser. No. 725,026 filed Apr. 19, 1985 now abandoned.

The present invention is directed to a process for the warp sizing of textile yarns and to the improved weaving properties of the yarns thus obtained. In addition, the invention relates to a process for warp sizing utilizing a warp size composition characterized by having improved compatability with textile sizing lubricants which moreover facilitates improved lubricant removability during desizing.

As used in this invention "warp" is an inclusive term which refers to the lengthwise running yarns in a woven fabric. A warp sizing material is any substance which is applied to the warp yarns for the basic purpose of strengthening and protecting the yarns from abrasion, usually as a result of its adhesive, film forming action. Warp sizes provide stiffness and smoothness to fibers which facilitate decreased incidents of entanglement and breakage during the weaving operation while also providing abrasion resistance to the fibers to avoid breakage and injury during handling.

The warp sizing, or slashing as it is often called, of textile yarns consists in the impregnation of these yarns with a sizing solution or dispersion. This is followed by removal of the excess sizing by passage of the wet yarns through a set of squeeze rolls followed by drying.

Warp sizing is carried out on a slashing machine consisting of a creel which generally holds one or more section beams. These section beams usually contain from 200–500 yarn ends. The yarn ends from several of these section beams are brought together so as to form a sheet of yarn with about 1500–8000 ends. This sheet then enters the size box wherein it is guided through the sizing solution and through one or more sets of squeeze rolls, so as to remove the surplus size which then falls back into the size box. Drying is accomplished by passing the yarn through a heated chamber or over the surface of internally heated drying cylinders.

The dried yarn is then separated by means of horizontal split rods into sections corresponding to those of the original section beams. The yarn is then almost immediately recombined by being passed through a vertical comb and thereupon onto a take-up beam referred to as a loom beam. This loom beam holds the yarn until such time as it is used in the weaving process.

One of the primary functions of the herein disclosed sizing process is to aid in the reduction of loom abrasion. To do this, the sizing must exert a film forming action, with the resultant film having the ability to resist the abrasive action of the various machine parts that come in contact with the yarns as well as the rubbing together of the individual yarns themselves.

Typical film-forming substances used as warp size materials have included starches, dextrins, glues, flours, gums, gelatin, cellulosics (i.e., carboxymethyl cellulose), polyvinyl alcohol, and polyacrylic acid. Many factors including the type and composition of fibers to be sized, construction, and count (weight per unit length) will determine which sizing materials or combination thereof should be employed.

Aqueous dispersons of starch and starch derivatives have been employed in the warp sizing of many natural, synthetic, or blended fibers. See, for example, the warp sizes of U.S. Pat. Nos. 2,946,705 (issued July 26, 1960 to H. Olsen) employing starch amine derivatives; 3,650,787 and 3,673,171 (issued Mar. 21, and June 27, 1972, respectively to L. Elizer) employing amphoteric and oxalkylated amphoteric starches; 3,719,664 (issued Mar. 6, 1973 to L. Hayes et al.) employing tertiary amine salts of starch half-acid esters; and 4,421,566 (issued Dec. 20, 1983 to M. Hasuly et al.) employing high amylose, cationic fluidity starch derivatives.

Lubricants are also conventionally employed in warp size compositions to improve weaving performance. The lubricants aid in reducing yarn-to-yarn and loom-to-yarn friction. Additionally they are noted to provide lubrication to loom parts during the later steps of the weaving process. Sizing compositions which evenly disperse the lubricants are particularly preferred as uniform lubricant distribution will help provide optimum weaving performance. The ability to improve loom efficiency (where 100% = no loom stops) by an amount of as little as 1 to 2% would be recognized in the field as a significant improvement.

Many varieties of fats, oils, and waves obtained from various animal, vegetable, mineral, or synthetic sources have been advantageously used for such lubrication in typical amounts ranging from about 0.5 to 10%, based upon the weight of the film-forming substance. Mill waxes which generally comprise tallow and hydrogenated tallow glycerides are typically employed as size lubricants.

Although the presence of size is necessary to make a yarn weave satisfactorily, it is equally true that complete removal of the size is an essential prerequisite to successful finishing. Therefore, in most cases subsequent to weaving, the woven textile must be desized in order to avoid interference of the size with finishing processes such as, for example, bleaching, dyeing, printing, and water repellancy treatment. Depending on the size composition employed, desizing is accomplished by one or more steps including: enzymatic or oxidative degradation, high temperature washing, steaming, caustic scouring, and solvent or surfactant treatment.

Although the film-forming portion of the size composition will normally be completely removed by the above methods, removability of the lubricant is significantly more difficult, often requiring expensive and time consuming removal techniques. It has been estimated that only approximately 25–30% of conventional size waxes on fabric are saponified or converted to water-soluble materials which are then removable. The remainder is not totally soluble and thus ends up on the fabric in the form of resist spots which are especially noticable after dyeing as exhibited by uneven dye penetration. Therefore, while uniform distribution of lubricant will result in the best weaving performance, it is also important for the textile finisher, who even if unable to remove it all, can achieve a condition which may permit a more regular and even appearance after dyeing.

Due to the current use of high speed air jet looms (with fill yarn insertion rates of 400–650 per minute as compared to 170–240 per minute for conventional looms), greater amounts of lubricants are sometimes employed to combat increased yarn stress encountered during weaving. With these higher quantities, lubricant removal, always a major cause for concern, is now aggravated.

It is an object of the present invention to provide a warp sizing composition capable of forming a uniform film upon warp yarns to sufficiently strengthen and protect them to withstand loom abrasion during conventional and high speed weaving.

It is a further object to provide a warp sizing composition capable of facilitating a uniform dispersion of textile lubricant in quantities equal to or greater than amounts conventionally used on the warp yarns.

It is also an object to provide a warp size composition which facilitates more complete lubricant removal after weaving employing inexpensive, less time-consuming methods.

SUMMARY

The above and related objects are provided by a warp size composition comprising 100 parts water; 2 to 40 parts of a hydrophobic starch derivative containing an ether, simple ester, or half-acid ester substituent with a saturated or unsaturated hydrocarbon chain of at least 5, and preferably 5 to 22, carbon atoms; and 3 to 50%, preferably 5 to 20%, of a lubricant, based on the weight of the starch derivative.

In a preferred embodiment, starch succinates prepared by reacting a fluidity corn starch base with about 1–10% octenyl succinic anhydride provide excellent weavability as well as uniform lubricant dispersion upon textile fibers. During desizing, the starch derivatives as well as the lubricant employed may be easily removed.

Other film-forming substances in addition to the starch derivative herein may be added to a warp sizing composition. In one embodiment, the warp size composition additionally comprises the synthetic resin polyvinyl alcohol, in equivalent amounts to the starch derivative.

A procedure for sizing textile fibers with the warp size composition herein is also taught.

DESCRIPTION OF THE PREFERRED EMBODIMENTS

The applicable starch bases which may be used in the preparation of the warp sizing derivatives herein include any amylaceous substance such as untreated starch, as well as starch derivatives including dextrinized, hydrolyzed, oxidized, esterified and etherified starches still retaining amylaceous material. The starches may be derived from any sources including, for example, corn, high amylose corn, wheat, potato, tapioca, waxy maize, sago or rice. Starch flours may also be used as a starch source.

By the term "simple ester" is meant an ester derived from a monofunctional acid (e.g. monocarboxylic or monosulfonic acid) which is distinguished from a "half-acid ester" having pendant carboxyl groups or acid radicals derived from an anhydride of a polycarboxylic acid.

By the term "hydrophobic starch" is meant a starch ether, simple ester or half-acid ester derivative wherein the ether, simple ester or half-acid ester substituent contains a saturated or unsaturated hydrocarbon chain of at least 5 carbon atoms. It should be understood that the hydrocarbon chain, which consists solely of carbon and hydrogen atoms, may contain some branching. We, however, prefer to employ those starch derivatives wherein the hydrocarbon chain is unbranched. It should also be understood that the substituent may contain other groups in addition to the at least $C_5$ hydrocarbon chain as long as such groups do not interfere with the hydrophobic properties of the substituent.

A suitable class of reagents for preparing half-acid starch esters useful herein include substituted cyclic dicarboxylic acid anhydrides such as those described in U.S. Pat. No. 2,661,349 (issued on Dec. 1, 1953 to Caldwell et al.) having the structure

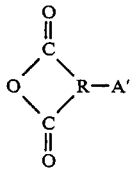

wherein R is a dimethylene or trimethylene radical and A′ comprises a hydrocarbon chain of at least 5, preferably 5–14, carbon atoms. The substituted cyclic dicarboxylic acid anhydrides falling within the above structural formula are the substituted succinic and glutaric acid anhydrides. In addition to the at least $C_5$ hydrocarbon chain, other substituent groups on the reagent such as sulfonic acid or lower alkyl which would not affect sizing performance may be present.

The starch half-acid esters useful herein are represented by the formula:

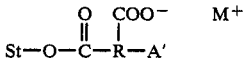

wherein St-O- represents a starch molecule, R represents dimethylene or trimethylene, A′ comprises a saturated or unsaturated hydrocarbon chain of at least 5 carbon atoms, and M is hydrogen, an alkali or an alkaline earth metal, or $NH_4$. A′ is preferably a $C_5$–$C_{22}$ alkyl or alkenyl group, and M is preferably sodium or potassium.

Another suitable class of reagents for preparing starch ester warp sizing derivatives useful herein include the imidazolides or N,N′-di-substituted imidazolium salts of carboxylic or sulfonic acids such as those described in U.S. Re. 28,809 (issued May 11, 1976 to M. Tessler) which is a reissue of U.S. Pat. No. 3,720,663 (issued on Mar. 13, 1973 to M. Tessler and U.S. Pat. No. 4,020,272 (issued Apr. 26, 1977 to M. Tessler) having the general formula

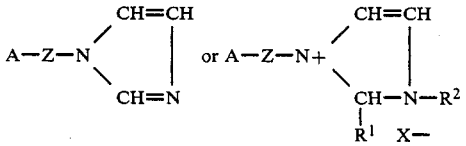

wherein Z is

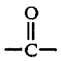

or $—SO_2—$, A comprises a hydrocarbon chain of at least 5, preferably 5 to 14, carbon atoms, $R^1$ is H or $C_1$–$C_4$ alkyl, $R^2$ is $C_1$–$C_4$ alkyl, and $X^-$ is an anion.

Starch esters useful herein are represented by the formula

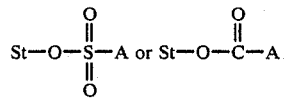

wherein St-O- represents a starch molecule and A comprises a saturated or unsaturated hydrocarbon chain of at least 5 carbon atoms. A is preferably a $C_5$ to $C_{22}$ alkyl or alkenyl group.

A third class of reagents useful herein include the etherifying reagents described in U.S. Pat. No. 2,876,217 (issued on Mar. 3, 1959 to E. Paschall) comprising the reaction product of an epihalohydrin with a tertiary amine. The amine may have the structure

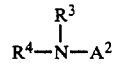

wherein $R^3$ and $R^4$ are independantly H or a $C_1$–$C_4$ alkyl and $A^2$ comprises a hydrocarbon chain of at least 5, preferably 5 to 14, carbon atoms.

A fourth class of reagents useful herein include the etherifying reagents described in U.S. Pat. No. 2,813,093 (issued Nov. 12, 1957 to C. Calwell et al.) comprising tertiary amine halides which contain a $C_5$ or greater alkyl or alkenyl group as one of the amine substituents.

The preferred starch ethers useful herein are represented by the formula

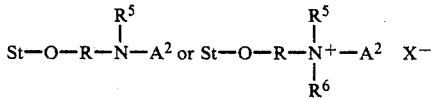

wherein St-O represents a starch molecule, R is an alkylene or hydroxyalkylene group, $R^5$ and $R^6$ are independently H or $C_1$–$C_4$ alkyl, $A^2$ comprises a hydrocarbon chain of at least 5 carbon atoms, and X is a halide (e.g. bromide or chloride). $A^2$ is most preferably a $C_5$ to $C_{22}$ alkyl or alkenyl group and R is most preferably a $C_2$–$C_4$ group.

The starch etherification or esterification reactions may be conducted by a number of techniques known in the art and discussed in the literature employing, for example, an aqueous reaction medium, or organic solvent medium, or a dry heat reaction technique. See, for example, R. L. Whistler, Methods in Carbohydrate Chemistry, Vol. IV, 1964, pp. 279–311; R. L. Whistler et al., Starch: Chemistry and Technology, Second Edition, 1984, pp. 311–366; and R. Davidson and N. Sittig, Water-Soluble Resins, 2nd Ed., 1968, Chapter 2. The warp sizing starch derivatives herein are preferably prepared employing an aqueous reaction medium at temperatures between 20° and 45° C.

For use in the warp sizing process, the starch derivatives may be produced either in gelatinized or ungelatinized form. The advantage of having the derivative in ungelatinized form is that it may be filtered, washed, dried and conveyed to the mill in the form of a dry powder.

When employing the cyclic dicarboxylic acid anhydride reagents, starch is preferably treated in granular form with the reagents in an aqueous alkali medium at a pH not lower than 7 nor higher than 11. This may be accomplished by suspending the starch in water, to which has been added (either before or after the addition of the starch) sufficient base such as alkali metal hydroxide, alkaline earth hydroxide, or ammonium hydroxide to maintain the mixture in an alkaline state during the reaction. The required amount of the reagent is then added, agitation being maintained until the desired reaction is complete. Heat may be applied, if desired, in order to speed the reaction; however, if heat is used, temperatures of less than about 40° C. should be maintained. In a preferred method, the alkali and the anhydride reagent are added concurrently to the starch slurry, regulating the rate of flow of each of these materials so that the pH of the slurry remains preferably between 8 and 11. After completion of the reaction, the pH of the reaction mixture is adjusted to a value of from about 3 to 7 with any commercial acid such as hydrochloric, sulfuric, or acetic acid, and the like. The starch half-acid ester is then recovered by conventional techniques.

Due to the greater hydrophobic nature of certain of the substituted cyclic dicarboxylic acid anhydride reagents useful herein (i.e., those having $C_{10}$ or higher substituents), the reagents react with starch in only minor amounts in standard aqueous reactions. In order to improve the starch reaction efficiency, starch is reacted with the hydrophobic reagent under standard aqueous conditions in the presence of at least 5%, preferably 7–15% (based on the weight of the reagent), of an organic quaternary salt which is employed as a phase transfer agent. The organic salts, of which trioctylmethyl ammonium chloride and tricaprylmethyyl ammonium chloride are preferably employed, as described in U.S. 3,992,432 (issued Nov. 16, 1976 to D. Napier et al.).

The proportion of etherifying or esterifying reagent used will vary with the particular reagent chosen (since they naturally vary in reactivity and reaction efficiency), and the degree of substitution desired. Thus, substantial improvements in warp sizing efficiency have been achieved by using a starch derivative made with 1% of the reagent, based on the weight of the starch. Preferred ranges are on the order of about 1 to 5%.

Warp sizing compositions must necessarily be resistant towards congealing in aqueous dispersion. This brings about improved workability of the sizing in the slasher, more uniform application and less gelling and lumping, thus leading to a reduction in the clogging of size lines and mechanical breakdowns.

It has been observed that some of the etherifying and esterifying reagents useful herein which possess linear chain hydrocarbon substituents containing 12 or more carbon atoms render starches capable in aqueous dispersion of forming high viscosity complexes with amylose at temperatures about 70° C. Sizing compositions are typically applied at temperatures ranging between 75° and 98° C. In order to avoid application problems, it may therefore be necessary to maintain the warp sizing composition at a temperature above that which the starch derivative is known to complex.

When employing waxy starch derivatives (composed primarily of amylopectin), no complex formation is exhibited at high temperatures. It has been discovered that the viscosity increases due to complex formation can also be eliminated by employing derivatives of converted starch bases, prepared by conventional acid conversion, enzyme hydrolysis, or oxidation procedures, which have been sufficiently converted depending upon the starch base and the hydrophobic derivatization employed. For example, the tetradecenyl succinate of corn starch will form complexes at high temperatures; however, an acid hydrolyzed corn starch base having a water fluidity (WF) of at least 40 which is treated with the same succinic anhydride reagent will not exhibit any detrimental effects due to complex formation and thus is useful at all typical application temperatures.

In practice, it has been found that the hydrophobic starch derivatives can be most effectively used as warp sizing agents when dispersed in water amounts ranging from 2 to 40 parts of the derivative per hundred parts of water. The precise amounts of the starch employed vary depending upon the weaving equipment, the fabric construction (i.e., the style) and the type of fiber being treated. The starch derivatives should be employed in substantially dispersed non-granular form in the warp size compositions of the present invention. Portions of granular starch in a warp size composition are known to have a deleterious effect on film formation providing inadequate strand protection as well as undesirable dusting at the slasher and during weaving.

The lubricants employed in the warp sizing composition may be selected from a wide variety of known synthetic and natural fats, oils, and waxes typically used to reduce friction during weaving. Preferred lubricants include vegetable and mineral oils and tallow. As with the starch derivatives, the amount of lubricant employed will vary depending mainly upon the weaving equipment and fiber to be lubricated. Typical amounts range between 0.5 to 15%, based on starch concentration. Larger amounts have not typically been employed due to the difficulties experienced when attempts are made to provide uniform lubricant distribution during sizing and acceptable lubricant removal during desizing. However, by employing the starch derivatives described herein, larger amounts of lubricant (i.e 20 to 50%) may be employed due to the improved lubricant distribution and removability facilitated by the derivatives.

In addition to the hydrophobic starch derivatives and lubricants employed in the present invention, other conventional warp size additives such as softeners, acrylic and polyester binders, anti-static agents and mildew preventatives may also be used in conventional amounts. Since many materials used as additives offer both a lubricating and a softening effect, lubricants are sometimes mistakenly referred to as softeners and vice versa. However, softeners (i.e., glycerine and soaps) are used to give a soft handle to the warp and the size film and to decrease the film brittleness through a plasticizing effect.

Other film-forming substances may also be employed in addition to the hydrophobic starch derivatives, if desired. Suitable substances for use herein would include, for example, polyvinyl alcohol, carboxylmethyl cellulose, and polyacrylic acid. If employed, such film forming substances are preferably present in amounts less than or equal to that of the hydrophobic starch.

The warp sizes produced herein are useful in the conventional warp sizing of any natural, synthetic or blended fiber as, for example, cotton, polyester, wool, nylons, rayons and glass fibers.

The following examples will illustrate the practice of this invention but they are not intended to limit its scope. In the examples, all parts and percentages are given by weight and all temperatures are in degrees Fahrenheit (Celsius). The wax removability of the warp sizes herein was qualitatively evaluated employing the following test procedure.

Dye Receptivity Test

An aqueous slurry comprising 8.8% of the starch derivative to be tested and 1.8% mill wax (20% wax based on starch) is cooked in a boiling water bath for 30 minutes in order to form a uniform dispersion. The wax employed is North Wax 686 (hydrogenated tallow) obtained from North Chemical Co. of Marietta, Ga. To obtain 10% by weight of the size on fabric, a 12×12 in. (0.305×0.305 m.) piece of 65/35 polyester-cotton fabric is saturated in the dispersion then run through a laboratory padder (manufactured by L & W Machine Works of Rock Hill, S.C.) for extraction at a pressure setting of 20. Thereafter, the fabric is dried in a forced draft oven at 270° F. (132° C.) for three minutes.

The fabric is desized by soaking the piece in an enzyme solution consisting of 2 parts enzyme (Super Exsize TX-2H obtained from Premier Malt of Peoria, Ill.), 0.75 parts surfactant (Triton X-100 obtained from Rohm and Haas of Philadephia, Pa.,), and 97.25 parts water at 160° F. (71° C.) for fifteen minutes. The fabric is then padder extracted, rinsed with water at 185°–190° F. (85°–88° C.) for ten minutes and washed with cold tap water for 3 minutes, then padder extracted again. Thereafter, the fabric is dried on a pin frame at 300° F. (149° C.) for three minutes. The fabric is finally scorched with an AATCC Scorch Tester (obtained from Atlas Electric Devices Co. of Chicago, Ill.) at 425° F. (218° C.) for 1 minute in order to exaggerate the effects of fabric dye absorbancy caused by the presence of any residual wax.

The dye solution employed is an aqueous solution comprising 0.3% acetic acid and 0.1% Sevron Brill Red 4G (obtained from Plyam Chemical, of Queens Village, N.Y.). The desized fabric is immersed in the dye solution which is maintained at 70°–74° F. (12°–24° C.) for 5 seconds then rinsed under cold tap water for approximately 15 seconds.

The uniformity of dye receptivity on fabric is a qualitative measure of wax removal. It is understood that the deeper and more uniform the dye penetration, the more complete the wax removal during desizing.

EXAMPLE 1

This example illustrates a laboratory procedure for preparing a converted half-acid ester starch succiniate derivative useful herein.

About 100 parts corn starch are slurried in 150 parts water followed by 0.55 parts of reagent-grade, concentrated hydrochloric acid. The temperature of the slurry is raised to 125° F. (52° C.) and the mixture is allowed to react with constant stirring for 16 hours. Thereafter, the pH of the hydrolyzed starch slurry is adjusted to 4.5 with sodium carbonate. After cooling the slurry to room temperature, the pH is adjusted to 7.5 by the addition of dilute sodium hydroxide (3%). A total of 1 part octenyl succinic acid anhydride (OSA) reagent is added slowly to the agitated starch slurry with the pH maintained at 7.5 by the metered addition of the dilute sodium hydroxide. After the reaction is complete, the pH is adjusted to about 5.5 with diluted hydrochloric acid (3:1). The starch is thereafter recovered by filtration, washed three times with water and air dried. The product will have an approximate water fluidity (WF) of 40 and carboxyl content of about 0.8%.

EXAMPLE 2

This example demonstrates the use of the product of the invention in an 11 can conventional pressure slasher on a polyester-cotton blend. A starch succinate made as in Example 1 was used to size 26/1 yarns for a 65/35 polyester-cotton poplin fabric of 96×60 construction.

Size A was prepared consisting of 100 lbs. of a starch succinate having a WF of 40 and made according to Example 1 with 1% OSA (based on starch solids); 14 lbs. mill wax; 100 lbs. polyvinyl alcohol; 80 lbs. 25% aqueous polyester binder and 150 gal. water. Application using a slasher at a pressure gauge reading of 15 psi resulted in a size content of 15.0%. For comparative purposes, conventional Size B for this style consisting of 100 lbs. fluidity corn starch (WF 20); 14 lbs. mill wax; 100 lbs. polyvinyl alcohol; 80 lbs. 25% aqueous polyester binder and 170 gal. water, resulting in a size content of 14.1% was also tested.

The warp yarns were woven on a conventional Draper X-3 loom at a rate of 178 yarn insertions per minute. Weaving efficiency with Size A was superior to comparative Size B as measured by loom efficiency (97–98% as opposed to 95–96%). Use of Warp Size A also resulted in less shedding at the bust rods (i.e., lease rods and on the loom) in comparison to Size B. The reduced shedding improves loom cleanliness and results in higher quality fabrics. Moreover, desizing and wax removal from the fabric woven with Size A was satisfactorily facilitated with only a standard enzyme technique while the fabric woven employing Size B required a solvent desize in order to provide satisfactory wax removal.

EXAMPLE 3

Size formulations C-E were prepared and evaluated as in Example 2 on 26/1 yarns for a 65/35 polyester-cotton fabric of 96×60 construction. The size formulations in addition to size content and weaving efficiency data may be found in Table I.

TABLE I

| Formulation | C | D | E |
|---|---|---|---|
| Starch succinate of Example 1 (lbs.) | 100 | 100 | 100 |
| Polyvinyl Alcohol (lbs.) | 100 | 50 | 0 |
| Mill wax (lbs.) | 14 | 11 | 8 |
| Water (gal.) | 175 | 125 | 70 |
| Finished gallons | 235 | 175 | 100 |
| Size content (%) | 11.8 | 11.5 | 12.5 |
| Weaving efficiency (%) | 98.2 | 98.8 | 98.8 |

From the above results it can be seen that all three formulations provided excellent weaving efficiency.

In a like manner, starches may be reacted with other suitable substituted dicarboxylic acid anhydrides such as those listed below and employed in warp sizing compositions with similar results expected:

pentyl succinic anhydride
pentenyl succinic anhydride
hexyl succinic anhydride
octyl succinic anhydride
nonenyl succinic anhydride
decyl succinic anhydride
decenyl succinic anhydride
dodecyl succinic anhydride
dodecenyl succinic anhydride
tetradecyl succinic anhydride
tetradecenyl succinic anhydride
hexadecyl succinic anhydride
hexadecenyl succinic anhydride
octadecyl succinic anhydride
3-methyl-hexenyl succinic anhydride

EXAMPLE 4

This example demonstrates the use of the present invention on a high speed loom. A starch succinate made as in Example 1 was used to size 35/1 yarns for a 50/50 polyester-cotton fabric of 74×54 construction (printcloth).

Size F was prepared consisting of 200 lbs. of a starch succinate having a WF of 40 and made according to Example 1 with 1% OSA (based on starch solids); 30 lbs. mill wax; 200 lbs. polyvinyl alcohol; and 235 gal. water. Comparative Size G, another conventional size for this style was prepared with 175 lbs. acetylated fluidity corn starch (WF 50) starch reacted with 4% acetic anhydride as described in U.S. Pat. No. 2,461,139 (issued Feb. 8, 1949 to C. Caldwell); 25 lbs. mill wax; 175 lbs. polyvinyl alcohol; 70 lbs. 50% aqueous polyester binder and 235 gal. water.

The sizes were applied to warp yarns which were woven on a Ruti high speed air jet loom run at a rate of 450 yarn insertions per minute. The size content and weaving efficiency data of the yarns may be found in Table II.

TABLE II

| | Size F | Size G |
|---|---|---|
| Size content (%) | 10.4 | 10.3 |
| Weaving efficiency (%) | 97–98 | 94–96 |

EXAMPLE 5

This example illustrates a laboratory study of the wax removability of the size compositions of the present invention by observing the dye receptivity of enzyme-desized fabric which had been impregnated with size compositions containing 20% wax (based on starch content).

Starch succinate derivatives were prepared as described in Example 1 by treating a fluidity corn starch (40 WF) with 1, 3, 5, or 10% OSA, based on starch solids. As an indication of reaction efficiency, the starch half acid esters were evaluated by carboxyl titration and found to contain 0.85, 2.96, 3.74, and 6.42% carboxyl groups, respectively.

Size dispersions containing mill wax were prepared and evaluated according to the Dye Receptivity Test procedure (described above) employing the starch succinate derivatives and a comparative fluidity corn starch (WF 40). The desized fabrics which had been treated with the starch succinate dispersions were all similar in appearance after dyeing. The fabrics treated with these sizes were more uniformly dyed and had significantly deeper dye penetration in comparison to the fabric treated with the comparative starch size. This indicates the wax of the size formulations containing the starch succinate derivatives was more effectively removed during desizing.

EXAMPLE 6

This example illustrates the effect of the starch derivatives herein to facilitate the removal of larger quantities of wax by comparing two sizing compositions containing 50% wax (based on starch content).

The starch succinate derivatives of Example 5 prepared from 40 WF corn starch and 1 or 3% OSA (based on starch solids) were evaluated by the Dye Receptivity Test as above except the size dispersions each contained 8.8% starch and 4.4% mill wax (as opposed to 1.8% wax).

Dye penetration of the desized fabric which had been treated with the size containing the 3% OSA starch derivative was significantly deeper than the fabric treated with size containing the less substituted starch derivative. The results indicated that when larger amounts of wax are employed in a size formulation, higher substituted starch succinate derivatives will facilitate better wax removal during desizing.

EXAMPLE 7

This example illustrates the effect of the starch derivatives herein to facilitate the removal of paraffin, another typical lubricant employed in warp size formulations.

Size dispersions were prepared and evaluated as described in the procedure for the Dye Receptivity Test with the exception that paraffin was employed at levels of 10 and 20% based on starch solids instead of the mill wax. Dispersions were prepared with the OSA starch of Example 1 and a comparative fluidity corn starch (WF 40). In order to thoroughly disperse the paraffin, the size compositions were continuously agitated during cooking.

The desized fabric which had been treated with OSA starch and 10 or 20% paraffin were quite similar in appearance, both exhibiting excellent dye penetration indicative of complete and near complete paraffin removal, respectively. With 10% paraffin, the comparative starch size provided slightly inferior paraffin removal to that of the OSA starch containing 20% paraffin. The comparative starch size containing 20% paraffin, however, was drastically inferior with the desized fabric containing numerous resist spots.

EXAMPLE 8

Starch succinate derivatives were prepared as described in Example 1 by treating a fluidity corn starch (41 WF) with 3% pentenyl succinic anhydride or 3% hexenyl succinic anhydride, based on starch solids. Fabrics treated with size dispersions containing the starch derivatives and 20% wax (based on starch content) were evaluated by the Dye Receptivity Test. Fabric treated with a comparative fluidity corn starch (WF 40) was also evaluated.

The desized fabrics which had been treated with the dispersions containing the starch succinate derivatives were similar in appearance after dyeing. The uniformity and depth of dye penetration were significantly better than that exhibited by the desized fabric which had been treated with the comparative fluidity starch dispersion.

EXAMPLE 9

This example demonstrates the ability of another starch derivative suitable for use in warp size compositions to provide improved wax removability during desizing.

Unhydrolyzed waxy maize starch was reacted with 5 or 10% tetradecenyl succinic anhydride (TDSA) as described in Example 1 in the presence of 0.7 parts (based on starch solids) of tricaprylmethyl ammonium chloride phase transfer agent at a pH of 8 instead of 7.5.

Size dispersions containing mill wax were prepared and evaluated by the Dye Receptivity Test employing the TDSA derivatives and two comparative fluidity corn starches having WF's of 20 and 40.

The desized fabrics which had been treated with the TDSA derivatives had significantly deeper dye penetration (with the fabric treated with more highly substituted TDSA derivative having the darkest color). The results indicate that superior wax removal was achieved with the sizes containing the TDSA starches.

EXAMPLE 10

This example illustrates the improved wax removability provided by starch derivatives suitable for use in warp size compositions which are prepared by additionally treating conventional sizing starches with a long hydrocarbon chain substituted succinic anhydride.

A. An acetylated fluidity corn starch described in Example 4 was prepared. A portion of this starch was additionally treated with 3% OSA. Sizing compositions containing the two starches were compared for wax removability by the Dye Receptivity Test. More uniform dye penetration of the fabric treated with the OSA derivatized starch was observed indicating the hydrophobic derivatization facilitated improved wax removability.

B. Another conventional starch employed as a warp size was prepared by reacting high amylose corn starch (containing approximately 50% amylose) with 6% diethylaminoethylchloride hydrochloride as described in U.S. Pat. No. 2,813, 093 (issued Nov. 12, 1957 to C. Caldwell et al.). A portion of this starch was additionally treated with 3% OSA. Sizing compositions containing the two starches were also compared as above. The fabric treated with the OSA derivatized starch was observed to have deeper dye penetration indicating the hydrophobic derivatization provided improved wax removal during desizing.

EXAMPLE 11

Starch ester derivatives, prepared employing N,N'-disubstituted imidazolium salts of long hydrocarbon chain carboxylic acids are also suitable for use in warp sizing compositions. This example demonstrates the ability of these derivatizes to facilitate improved wax removal during desizing.

Corn starch was acid hydrolyzed to a WF of 41 then reacted with 5 or 10% N-decanoyl-N'-methylimidazolium chloride (based on starch solids) employing a procedure described in U.S. Pat. No. 4,020,272 (cited previously). The procedure comprised slurrying 100 parts corn starch (as is) in 150 parts water at pH 8 and then slowly adding the reagent to the slurry. The reaction was conducted for 2 to 3 hours at room temperature while maintaining the pH at 8 as described in Example 1. When the reaction is complete, the pH of the slurry was adjusted to 4 with 3:1 hydrochloric acid. The starch ester derivatives were recovered by filtration, washed three times with water having a pH of about 4, and air dried.

Size dispersions containing the ester derivatives and mill wax were evaluated by the Dye Receptivity Test and compared to a similar dispersion containing an underivatized fluidity corn starch (WF 40).

Dye penetration of the fabrics treated with the starch ester derivatives was deeper in comparison to the fabric treated with the underivatized corn starch size. Dye uniformity of the fabric treated with the more highly substituted starch ester was also noted to be by far the best of the series. The results indicate that the hydrophobic starch esters are useful in facilitating wax removal during desizing.

Other suitable esterifying reagents which may be employed in the preparation of starch derivatives useful in warp size compositions with similar effectiveness expected include, for example, the N,N'-disubstituted imadazolium salts of the following acids:

hexanoic acid
2-ethylhexanoic acid
caprylic acid
lauric acid
myristic acid
palmitic acid

EXAMPLE 12

Starch ether derivatives, prepared by employing long hydrocarbon chain quaternary amine epoxide reagents, are suitable for use in warp sizing compositions. This example demonstrates the ability of these derivatives to also provide improved wax removability during desizing.

Corn starch was acid hydrolyzed to a WF of 41 then reacted with 5 or 10% dimethylglycidyl-N-dodecyl ammonium chloride (based on starch solids) employing the procedure described in U.S. Pat. No. 2,876,271 (cited previously). The procedure comprised slurrying 100 parts starch (as is) in 150 parts water containing 40 parts sodium sulfate and 3 parts sodium hydroxide. The reagent was added and the mixture was agitated for 16 hours at 104° F. (40° C.). Thereafter the pH was adjusted to 3 with 3:1 hydrochloric acid. The starch ethers were filtered (methanol was added to aid in the filtration), then washed three times with water having a pH of about 3, and air dried.

Size dispersions containing mill wax were prepared and evaluated by the Dye Receptivity Test employing the starch ether derivatives and a comparative underivatized fluidity corn starch (WF 40).

The dye penetration of the desized fabric which had been treated with the less substituted starch ether derivative was poorer than that of the fabric treated with the underivatized corn starch size. Dye penetration and uniformity of the fabric treated with the more highly substituted stach ether, however, was far superior to that exhibited by the comparative sample. The results indicate that although both starch ether derivatives are useful in warp sizing compositions, in order to facilitate sufficient wax removal (when employing high concentrations of about 20% based on starch), the more highly substituted starch ether is preferably employed.

In a like manner, starches may be reacted with other substituted quaternary amine epoxide reagents and employed in warp size compositions with similar effectiveness expected. Suitable reagents include, for example, the reaction products of epihalohydrins with one of the long chain tertiary amines listed below:

pentyldimethylamine
hexyldimethylamine
octyldimethylamine
2-ethylhexyldimethylamine
nonyldimethylamine
decyldimethylamine
decenyldimethylamine
dodecenyldimethylamine
tetradecyldimethylamine
tetradecenyldimethylamine
hexadecyldimethylamine
hexadecenyldimethylamine
octadecyldimethylamine
octadecenyldimethylamine
didecylmethylamine

EXAMPLE 13

Hydrophobic starch ether derivatives, prepared by employing a tertiary amine halide etherifying agent substituted with at least one long hydrocarbon chain are suitable for use in warp sizing compositions. This example demonstrates the ability of these derivatives to also provide improved wax removability during desizing.

Corn starch was acid hydrolyzed to a WF of 40 then reacted with 10% N-octyl-N-ethyl aminoethyl chloride (based on starch solids) employing the procedure described in U.S. Pat. No. 2,813,093 (cited previously). The procedure comprised slurrying 100 parts starch (as is) in 150 parts water containing 40 parts sodium sulfate and 1.5 parts sodium hydroxide. The pH was adjusted to 11.2 with the addition of 4.5% sodium hydroxide in 10% aqueous sodium sulfate. The temperature was raised and maintained at 45° C., 10 parts of the reagent was slowly added, and the mixture was agitated for 16 hours. Thereafter the pH was adjusted to 5.5 with 3:1 hydrochloric acid. The starch ether was filtered, resuspend in ethanol, refiltered, washed with three times with pH 5 water, and air dried.

A size dispersion containing the ether derivative and mill wax was evaluated by the Dye Receptivity Test and compared to a similar dispersion containing the underivatized fluidity corn starch base.

Dye penetration and uniformity of the fabric treated with the hydrophobic starch ether was superior to that exhibited by the comparative sample.

Other useful starch derivatives for the warp sizing compositions herein are quaternary ammonium salts of starch ethers prepared from the useful tertiary amine starch derivatives and alkyl halides or other suitable alkylating agents.

Summarizing, a warp sizing composition and a process for the use thereof are provided whereby the composition is capable of strengthening and protecting warp yarns to withstand loom abrasion as well as facilitating uniform textile lubricant dispersion onto the warp yarns and providing efficient lubricant removal during desizing.

The preferred embodiments of the present invention having been described above, various modifications and improvements thereon will now become readily apparent to those skilled in the art. Accordingly, the spirit and scope of the present invention is defined not by the foregoing disclosure, but only by the appended claims.

What is claimed is:

1. In an improved process for the warp sizing of textile yarns comprising passing the yarns through a sizing composition of the type containing water, a starch derivative, and a lubricant; wherein the improvement comprises (a) the presence, as the starch derivative, of a hydrophobic starch derivative containing an ether or simple ester substituent with a saturated or unsaturated hydrocarbon chain of at least 6 carbon atoms; and (b) the presence of about 3 to 50% of the lubricant, based on the weight of the hydrophobic starch derivative; the warp sizing composition being characterized by uniform lubricant dispersibility during sizing and efficient lubricant removability during desizing.

2. The process of claim 1 wherein the lubricant is selected from synthetic and natural fats, oils and waxes.

3. The process of claim 2 wherein the lubricant is selected from the group consisting of tallow, hydrogenated tallow and paraffin.

4. The process of claim 1 wherein the hydrophobic starch simple ester derivative has the formula: St-O-Z-A wherein St-O represents a starch molecule, Z is

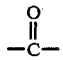

or $—SO_2—$, and A is a saturated or unsaturated hydrocarbon chain of 6–22 carbon atoms.

5. An improved process for the warp sizing of textile yarns comprising passing the yarns through a sizing composition of the type containing water, a starch derivative, and a lubricant, the improvement comprising (a) employing, as the starch derivative, a hydrophobic starch half-acid ester having the formula: formula:

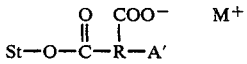

wherein St-O- represents a starch molecule, R is dimethylene or trimethylene, A′ comprises a saturated or unsaturated hydrocarbon chain of at least 5 carbon atoms, and M is selected from the group consisting of hydrogen, an alkali or an alkaline earth metal, and $NH_4$; and (b) the presence of the lubricant selected from synthetic and natural fats, oils and waxes in an amount of about 3 to 50% based on the weight of the hydrophobic starch half-acid ester; the warp sizing composition being characterized by uniform lubricant dispersibility during sizing and efficient lubricant removability during desizing.

6. The process of claim 5, wherein the lubricant is selected from the group consisting of tallow, hydrogenated tallow, and paraffin.

7. The process of claim 5, wherein the lubricant is present in amounts of 5 to 20%.

8. The process of claim 5 wherein 100 parts of the water and 2 to 40 parts of the starch derivative are present.

9. The process of claim 5, wherein R is dimethylene and A′ is $C_5$–$C_{22}$.

10. The process of claim 9, wherein the starch derivative is a cornstarch or a fluidity corn starch.

11. The process of claim 5 wherein the starch derivative is a hydrophobic starch half-acid ester which is prepared employing octenyl succinic anhydride as the esterifying reagent.

* * * * *